US005897449A

United States Patent [19]

Roberts et al.

[11] Patent Number: 5,897,449

[45] Date of Patent: Apr. 27, 1999

[54] STABILIZING VANES FOR ARCHERY ARROWS

[75] Inventors: Kent S. Roberts; Brent J. Roberts, both of American Fork, Utah

[73] Assignee: Inventive Technology, American Fork, Utah

[21] Appl. No.: 08/781,881

[22] Filed: Jan. 10, 1997

[51] Int. Cl.[6] ..... F42B 6/06

[52] U.S. Cl. ..... 473/586

[58] Field of Search ..... 473/586, 578, 473/585, FOR 223, FOR 216, FOR 220

[56] References Cited

U.S. PATENT DOCUMENTS

| | | | |
|---|---|---|---|
| 2,899,773 | 8/1959 | Lockwood | 473/586 X |
| 2,976,042 | 3/1961 | Barnett | 473/586 |
| 4,012,043 | 3/1977 | Carella | 473/586 |
| 4,392,654 | 7/1983 | Carella | 473/586 |
| 5,119,797 | 6/1992 | Anderson | 473/578 X |
| 5,311,855 | 5/1994 | Basik | 473/586 X |

OTHER PUBLICATIONS

Bow & Hunting, Oct. 1992, p. 31 Introducing the Starflight System.

*Primary Examiner*—Paul E. Shapiro
*Attorney, Agent, or Firm*—Mallinckrodt & Mallinckrodt

[57] ABSTRACT

A stabilizing vane for use with an archery arrow includes an elongate vane body with an inclined surface attached thereto. The inclined surface is confined substantially within the upper portion of the vane body spaced from the arrow shaft so as to be cooperable with an arrow rest. The inclined surface can be oriented to optimize arrow rotation and centering.

19 Claims, 1 Drawing Sheet

STABILIZING VANES FOR ARCHERY ARROWS

BACKGROUND OF THE INVENTION

1. Field

The invention is in the field of archery arrows and stabilizing vanes for archery arrows.

2. State of the Art

It is generally known that the flight of an archery arrow can be stabilized to some degree by causing the arrow to rotate during its flight. In the prior art, where arrow rotation is desired, the arrow vanes or fletching have been attached to an arrow shaft at an angle to the longitudinal axis of the shaft to impart rotation to the shaft during flight. However, with many of the newer arrow rests currently in use, the arrow supporting portion of the rest contacts the arrow shaft adjacent the vanes as the vanes pass through or over the rest. With such rests, angled vanes have difficulty clearing the arrow rest when the arrow is shot. The vanes often contact portions of the rest, thereby deflecting the arrow's path. Thus, rather than stabilizing the arrow's flight, the contacting of the vanes with the arrow rest actually destabilize and interfere with the accurate flight of the arrow. Thus, many arrows used today have vanes aligned with the longitudinal axis of the arrow shaft and there is no means provided for causing rotation of the arrow during flight. Other arrows have very limited vane angle so that the vanes will clear most arrow rests. However, the small degree of vane angle gives very limited arrow rotation so its stabilizing effect is very limited.

SUMMARY OF THE INVENTION

According to the invention, an effective stabilizing vane that is cooperable with an arrow rest is formed by confining elevations or inclined surfaces on the vane body surfaces to substantially the upper portion of the vane body. The lower portion of the vane body adjacent the arrow shaft is aligned with the longitudinal axis of the arrow shaft and is substantially free of inclined or angled surfaces adjacent the arrow shaft so as to allow ample clearance between the stabilizing vanes and an arrow rest during use.

In a preferred embodiment of the invention, the stabilizing vanes are mounted on the rearward portion of the arrow. Each stabilizing vane comprises a substantially rigid vane body with an inclined surface thereon spaced outwardly from the arrow shaft. The inclined surface may be in the form of a rigid wedge attached to the vane body. Generally, the wedge is integrally molded to a surface of the vane body. In the preferred embodiment, the wedge is confined to the upper rearward portion of the vane surface. However, various other inclined surfaces may be used singularly or together and may be attached to one or both sides of the vane body. In addition, there is no requirement that the inclined surface be confined to the rearward portion of the vane body. For example, a wing-like surface could be used which spans the entire length of the vane and beyond. As long as an inclined surface or surfaces are confined to the upper portion of the vane body and are of stabilizing design, the surface or surfaces may be used.

It has been found that an inclined surface formed by a wedge formation extending from the upper and rearward portion of the vane body works well and is currently preferred.

THE DRAWINGS

The best mode presently contemplated for carrying out the invention is illustrated in the accompanying drawings, in which:

FIG. 1 is a side elevation of an arrow including stabilizing vanes of the invention;

FIG. 2, an enlarged side elevation of the vane assembly and rear portion of the arrow of FIG. 1;

FIG. 3, a rear elevation of the arrow of FIG. 1;

FIG. 4, a top plan view of the rear portion of the arrow taken on the line 4—4 of FIG. 2; and FIG. 5, a view similar to that of FIG. 4 showing a different wedge configuration.

DETAILED DESCRIPTION OF THE ILLUSTRATED EMBODIMENT

An archery arrow generally includes an arrow tip 10, an arrow shaft 11, a plurality of vanes 12 mounted on the rearward portion of the arrow and a nock 13. The vanes may be mounted directly to the rear portion of the usual arrow shaft such as by gluing to an aluminum or carbon fibre shaft, or may be a molded assembly that fits into or over the end of the normal shaft and in effect forms an extension of the shaft, such as shown in U.S. Pat. No. 5,439,231. In many cases it is desirable to impart a rotation or spin to an archery arrow about the longitudinal axis of the arrow. This tends to stabilize the arrow during flight to produce a straighter and more accurate flight path. The current invention provides a substantially straight vane with an inclined surface extending from the upper portion of the vane spaced radially outwardly from the arrow shaft so as to not hit or otherwise contact or interfere with an arrow rest over or through which the arrow may pass when shot.

Figure 1:
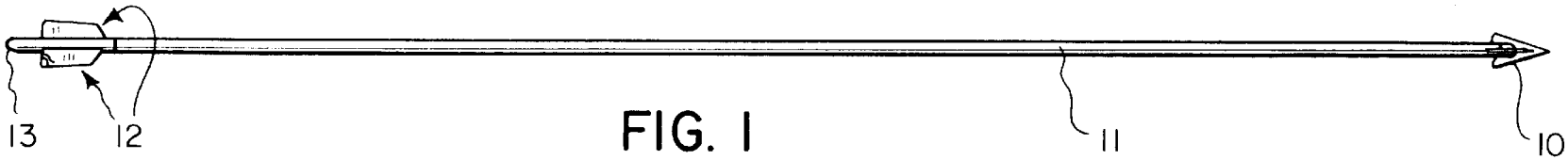
Figure 2:
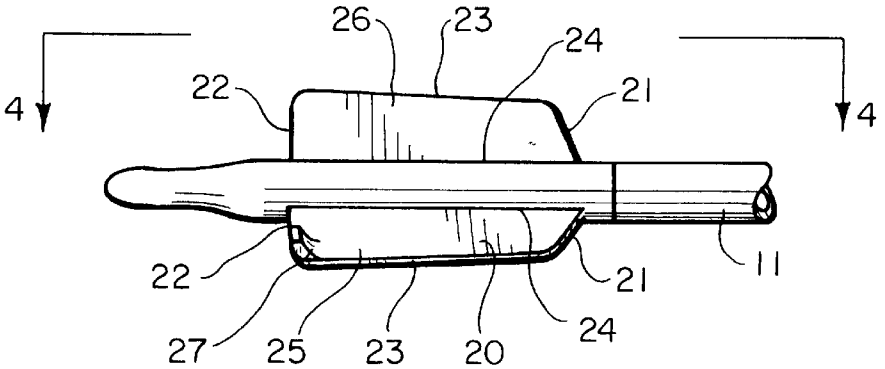
Figure 3:
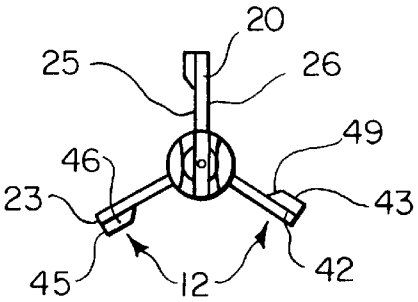
Figure 4:
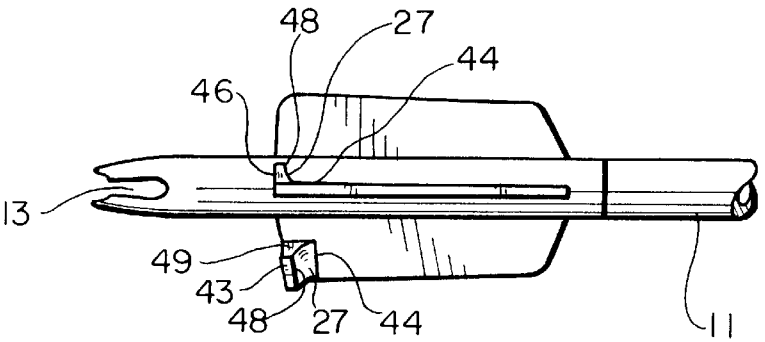
Figure 5:
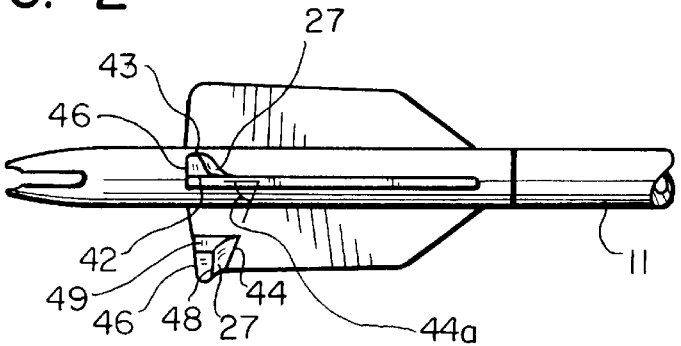

As illustrated, a preferred embodiment of a stabilizing vane 12 include a rigid vane body 20 with a length, a forward end 21 and a rearward end 22, an upper edge 23 and a substantially straight lower edge 24, two opposite side surfaces 25 and 26, and an inclined surface 27 attached to the vane body. Generally, only one side surface 25 or 26 of the vane body has an inclined surface extending therefrom. However, multiple inclined surfaces attached to a single side or surface attached to both sides could be used. The inclined surface 27 may advantageously be formed by a rigid wedge formation which extends from a side surface, such as 25, of the vane. The wedge formation is preferably located at the rearward end of the vane body and substantially within the upper portion of the vane body spaced from the arrow shaft. The wedge illustrated has a bottom surface 42, a top surface 43 parallel to the bottom surface and parallel to the vane side surface 25 from which the wedge formation extends. The wedge formation is preferably integrally molded with vane body 20, but may be a separate piece attached to vane body 20, such as by gluing. The top surface 43 of the wedge formation is smaller than the bottom surface 42. The wedge has a bottom forward edge 44 that represents the junction of the inclined surface 27 with the side surface 25 of the vane body 20. This edge 44 may be substantially perpendicular to the longitudinal axis of the arrow shaft as shown in FIG. 4, or may be at an angle to the longitudinal axis. Edge 44 may angle outwardly and rearwardly as shown in FIG. 5, with an angle 44*a*, FIG. 5, of about 80° from the longitudinal axis having been found satisfactory for good arrow performance. It is currently preferred that the edge 44 be angled outwardly and rearwardly as shown in FIG. 5 because it has been found that such angle results in better centering of the arrow, i.e., aligning of the arrow with its direction of travel. As the angle 44*a* decreases, the speed of rotation of the arrow is lessened, but the faster the centering of the arrow. The upper or outer edge 45 of the wedge is preferably parallel to the upper edge 23 of the vane body and the rear edge 46 of the wedge is preferably parallel to the rear edge 22 of the vane body such that no part of the wedge extends rearwardly or upwardly beyond the vane body 20. In the illustrated embodiment, the inclined surface 27 is at least in part arcuate between the bottom forward edge 44 and the top forward edge 48 of the wedge formation. A non-arcuate flat surface or multiple sloped surface may alternately be used. The inner edge 49 of the wedge formation is substantially parallel to the longitudinal axis of the arrow, and preferably sloping as shown. Alternatively, the inner edge 49 may be angled rearwardly and downwardly toward the arrow shaft.

Various other inclined surfaces attached to substantially the upper portion of the vane body to impart arrow rotation and provide flight stability may be used. For example, the inclined surface could be a wedge with the thin part beginning at the forward end 21 of the vane body 20 and the thick part terminating at the rearward end 22 where additionally the wedge is substantially contained within the upper or outer portion of the vane body. The inclined surface could be bowed to form a wing-like structure. The inclined surface could extend beyond the rearward 22 or forward 21 ends or the upper edge 23 of the vane body. Tabs projecting from a vane body surface 25 could be used. Alternatively, the upper rearward portion of the vane body could itself be bent to form an inclined surface. An important feature of the invention is that the inclined surfaces are spaced on the vane outwardly from the arrow shaft so that an inner portion of the vane adjacent the arrow shaft remains substantially straight and aligned with the arrow shaft so as to easily pass through an arrow rest which may be used when shooting the arrow. Another important feature of the invention in the embodiment of FIG. 5 is that the inclined surface faces somewhat outwardly to provide a centering effect to the arrow. The degree of rotation and centering can be optimized for different arrows to provide greater accuracy.

In use on an arrow shaft of an arrow, the stabilizing vanes of the invention should readily clear any arrow rest which a straight vane will clear.

The angle of slope of the inclined surfaces, the height of a wedge or other formation forming the inclined surfaces, and other parameters of the inclined surfaces are formulated to provide a stabilizing rotation to the arrow. With the wedge formation shown in FIG. 4, if the wedge formation has a height of about 0.1 inch, the arrow has been found to rotate at about seven rotations in about twenty yards. With a wedge formation height of about 0.15 inch, the arrow rotates at about fourteen rotations in about twenty yards. With the wedge formation shown in FIG. 5, at 0.15 inch the rate of rotation dropped to about ten rotations in twenty yards.

The vanes of the invention may be substantially rigid, or may be flexible to the extent of any currently used flexible vanes. However, substantially rigid vanes are currently preferred. If the vanes are provided as a molded unit such as shown in U.S. Pat. No. 5,439,231, the unit may fit into the rearward end of an arrow shaft such as an aluminum arrow shaft, may fit over the end of an arrow shaft such as a carbon fibre shaft, or could fit over and be slid along either type of arrow shaft.

While the invention has been indicated as being compatible with various arrow rests, there are some arrow rests that are not compatible with the substantially rigid vanes. Thus, it does not work with all arrow rests. With the vanes of the invention and compatible arrow rests, the parameters of the inclined surface as indicated can be made to optimize rotation and centering of the arrow.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

We claim:

1. A stabilizing vane for use with an archery arrow shaft to form an archery arrow, comprising:

a vane body having a length, a forward end and a rearward end, a lower edge for placement adjacent the arrow shaft, an upper portion spaced upwardly from the lower edge, and opposite side surfaces; and at least one inclined surface within the upper portion of the vane body projecting outwardly from a side surface of the vane body.

2. A stabilizing vane of claim 1, wherein the inclined surface forms a wedge which has a top surface parallel to the side surfaces of the vane body with the top surface of the wedge having less area than the bottom surface of the wedge and the bottom surface of the wedge attached to a side surface of the vane body.

3. A stabilizing vane of claim 2, wherein the bottom surface of the wedge is integrally molded to a side surface of the vane body.

4. A stabilizing vane of claim 3, wherein the wedge and vane body are rigid.

5. A stabilizing vane of claim 4, wherein the vane body has an upper edge, wherein the wedge has a top upper edge and a rear edge, wherein the top upper edge of the wedge is parallel to the upper edge of the vane body, and the top rear edge of the wedge is parallel to the rear edge of the vane body.

6. A stabilizing vane of claim 5, wherein the wedge has a bottom forward edge, and the bottom forward edge is perpendicular to the upper edge of the, body of the vane.

7. A stabilizing vane of claim 5, wherein the wedge has a bottom forward edge that slopes such that the part of the edge nearest the upper edge of the vane is closer to the rearward end of the vane.

8. A stabilizing vane of claim 4, wherein the wedge has a bottom forward edge, and the bottom forward edge is perpendicular to the upper edge of the body of the vane.

9. A stabilizing vane of claim 4, wherein the wedge has a bottom forward edge that slopes such that the part of the edge nearest the upper edge of the vane is closer to the rearward end of the vane.

10. A stabilizing vane of claim 3, wherein the vane body has an upper edge, wherein the wedge has a top upper edge and a rear edge, wherein the top upper edge of the wedge is parallel to the upper edge of the vane body, and the top rear edge of the wedge is parallel to the rear edge of the vane body.

11. A stabilizing vane of claim 3, wherein the wedge has a bottom forward edge, and the bottom forward edge is perpendicular to the upper edge of the body of the vane.

12. A stabilizing vane of claim 3, wherein the wedge has a bottom forward edge that slopes such that the part of the edge nearest the upper edge of the vane is closer to the rearward end of the vane.

13. A stabilizing vane of claim 2, wherein the wedge and vane body are rigid.

14. A stabilizing vane of claim 13, wherein the vane body has an upper edge, wherein the wedge has a top upper edge and a rear edge, wherein the top upper edge of the wedge is parallel to the upper edge of the vane body, and the top rear edge of the wedge is parallel to the rear edge of the vane body.

15. A stabilizing vane of claim 13, wherein the wedge has a bottom forward edge, and the bottom forward edge is perpendicular to the upper edge of the body of the vane.

16. A stabilizing vane of claim 13, wherein the wedge has a bottom forward edge that slopes such that the part of the edge nearest the upper edge of the vane is closer to the rearward end of the vane.

17. A stabilizing vane of claim 2, wherein the vane body has an upper edge, wherein the wedge has a top upper edge and a rear edge, wherein the top upper edge of the wedge is parallel to the upper edge of the vane body, and the top rear edge of the wedge is parallel to the rear edge of the vane body.

18. A stabilizing vane of claim 2, wherein the wedge has a bottom forward edge, and the bottom forward edge is perpendicular to the upper edge of the body of the vane.

19. A stabilizing vane of claim 2, wherein the wedge has, a bottom forward edge that slopes such that the part of the edge nearest the upper edge of the vane is closer to the rearward end of the vane.

* * * * *